US012358667B2

(12) United States Patent
Morri

(10) Patent No.: US 12,358,667 B2
(45) Date of Patent: Jul. 15, 2025

(54) SELF-PROPELLED WRAPPING MACHINE

(71) Applicant: ROBOPAC S.P.A., Acquaviva-Gualdicciolo (SM)

(72) Inventor: Marco Morri, Acquaviva-Gualdicciolo (SM)

(73) Assignee: ROBOPAC S.P.A., Acquaviva -Gualdicciolo (SM)

( * ) Notice: Subject to any disclaimer, the term of this patent is extended or adjusted under 35 U.S.C. 154(b) by 0 days.

(21) Appl. No.: 18/291,011

(22) PCT Filed: Jul. 21, 2022

(86) PCT No.: PCT/IB2022/056743
§ 371 (c)(1),
(2) Date: Jan. 22, 2024

(87) PCT Pub. No.: WO2023/002425
PCT Pub. Date: Jan. 26, 2023

(65) Prior Publication Data

US 2024/0327046 A1 Oct. 3, 2024

(30) Foreign Application Priority Data

Jul. 23, 2021 (IT) ..... 102021000019667

(51) Int. Cl.
*B65B 11/02* (2006.01)

(52) U.S. Cl.
CPC ..... *B65B 11/025* (2013.01); *B65B 2210/18* (2013.01)

(58) Field of Classification Search
CPC ... B65B 11/025; B65B 2210/18; B65B 57/16; B65B 11/02; B65B 57/00; B65B 59/04
(Continued)

(56) References Cited

U.S. PATENT DOCUMENTS 10,549,870 B2 * 2/2020 Luo ..... B65B 57/08
2007/0169442 A1 * 7/2007 Asioli ..... B65B 11/025 53/588

FOREIGN PATENT DOCUMENTS

IT MI20 090 068 7/2010

OTHER PUBLICATIONS

International Search Report (ISR) issued Nov. 22, 2022 in International (PCT) Application No. PCT/IB2022/056743.
(Continued)

*Primary Examiner* — Thanh K Truong
*Assistant Examiner* — Xavier A Madison
(74) *Attorney, Agent, or Firm* — WENDEROTH, LIND & PONACK, L.L.P.

(57) ABSTRACT

A self-propelled wrapping machine movable on a supporting surface includes a self-propelled carriage provided with a drive wheel for moving the self-propelled wrapping machine and a lifting device having a supporting element provided with an idle auxiliary wheel associated with the carriage and selectively movable between a raised position, where the auxiliary wheel is spaced from a supporting plane, and a lowered position, where the auxiliary wheel abuts the supporting plane and lifts and detaches the drive wheel from the supporting plane. The supporting element is rotatably associated with the carriage to rotate between the raised and lowered positions. The lifting device has a lever rotatably supported by the carriage, connected to the supporting element by a connecting element and movable between a non-operating position and an operating position, where the lever arranges the supporting element respectively in the raised and lowered positions.

7 Claims, 2 Drawing Sheets

(58) Field of Classification Search
USPC ..... 53/580
See application file for complete search history.

(56) References Cited

OTHER PUBLICATIONS

Robopac S.P.A., "Self propelled wrapping robot, Robot S6, Use and Maintenance Manual", Mar. 21, 2017, XP055905084, Retrieved from the Internet: URL:https://robopacusa.com/wp-content/uploads/2020/05/Robot-S6-User-Manuel.pdf [retrieved on Mar. 24, 2022], cited in CA.

* cited by examiner

SELF-PROPELLED WRAPPING MACHINE

The invention relates to a mobile or self-propelled wrapping machine configured to wrap a film made of plastic material around a load consisting of a product or a group of products arranged on a bed or pallet.

Self-propelled wrapping machines, also referred to as self-propelled wrapping robots, are machines generally used to wrap loads having variable shapes and sizes and in productions in limited amounts, typically in environments or accommodations where fixed or static wrapping machines cannot be used because of their overall dimensions and/or the available spaces. Loads are generally formed by bend or pallets on which a group of more or less regularly overlapped products and/or objects, even having different sizes and shapes, is arranged.

In other cases, the wrapping, normally for protective purposes, directly concerns the product, which is generally large-sized.

The self-propelled wrapping machines include a cart or carriage that supports a vertical upright along which a film unwinding or supplying unit, which houses a reel of plastic film and is generally provided with a plurality of rollers for unwinding and pre-stretching the film, is movable with alternating rectilinear motion. The carriage is usually provided with rear wheels, at least one of which is a motorized drive wheel and a front steering device which comprises one or more steering wheels, operated by a steering. The steering can be operated by means go a maneuvering bar by an operator to manually move the machine in a maneuvering configuration, or from by means of a feeler element capable of following the profile or external shape of the load in an operating working configuration, in which the self-propelled machine turns autonomously and automatically around the load to wrap it with the film.

The combination of the alternating linear movement of the unwinding unit along the vertical upright and the rotation of the self-propelled machine around the load allows the film to be wrapped around the load so as to form a series of intertwined strips or bands. The plastic film is wrapped to completely bind up the load on all its sides.

For such self-propelled wrapping machines, the problem of their displacement in the manicuring configuration is known. In particular, the drive wheel or wheels resist the movement imposed by the operator wishing to move the wrapping machine, for example from a first wrapped load to a further load to be wrapped.

A solution proposed in the prior art is to provide for the uncoupling of the drive wheel from the drive motor by means of mechanical systems, so as to make the drive wheel idle during the movement steps, thus allowing the operator to easily move the wrapping machine.

However, the proposed solution has the disadvantage that the wrapping machines have to include complex and expensive mechanical uncoupling systems of the drive wheel.

ITMI20090068 discloses a self-propelled wrapping machine that comprises a self-propelled carriage provided with two rear wheels, at least one of which is driven by a motor, and a pair of steering wheels mounted idle on a steering body which is rotatable about a vertical pin connected to a maneuvering bar which can be operated manually by an operator to manoeuvre the wrapping machine. The steering body is associated with a feeler arm, one end of which is fixed to the steering body while the other end is provided with a contact roller which, under the action of respective spring means, abuts the side surface of the load to be wrapped. On the lower end of the vertical pin below the steering body, a maneuvering wheel is mounted which is free to rotate about the aforesaid vertical pin. The vertical pin can be moved vertically by the maneuvering bar so as to move the maneuvering wheel between a raised position in which it is detached from the ground to allow the steered wheels to guide the self-propelled carriage during the operation of the machine, and a lowered position in which the maneuvering wheel rests on the ground and lifts the steering wheels to allow the manual movement of the machine. More precisely, the pin is moved from the raised position to the lowered position by moving the maneuvering bar from a vertical position to a horizontal position. Thereby, the wrapping machine can be easily moved manually without the need to steer the steering wheels and thus to overcome the resistance of the spring means acting on the steering body. To further facilitate the manual movement, the wrapping machine also includes a system adapted to uncouple the motor from the drive wheel.

An object of the invention is to improve the known self-propelled wrapping machines arranged to wrap a load with an extensible plastic film.

Another object is to provide a self-propelled wrapping machine which can be easily and handy moved and displaced by an operator in a maneuvering configuration, outside the operating wrapping cycles.

A further object is to carry out a wrapping machine having a safe and reliable operation and low production cost.

The invention provides a self-propelled wrapping machine according to independent claim 1.

The self-propelled wrapping machine of the invention is movable on a supporting surface to wrap a load with a plastic film and comprises a self-propelled carriage provided with at least one drive wheel suitable for moving the self-propelled wrapping machine, an upright fixed to the carriage and slidably supporting an unwinding unit provided with at least a reel of film, and at least one lifting device which includes a supporting element provided with an idle auxiliary wheel; the supporting element is associated with the carriage and is selectively movable between a lowered position, in which the auxiliary wheel abuts the supporting plane and lifts and detaches the drive wheel from the supporting plane, and a raised position, in which the auxiliary wheel is spaced from the supporting plane. The supporting element is rotatably associated with a side of the carriage, adjacent to the drive wheel so as to rotate between the raised position and the lowered position.

The lifting device comprises a lever rotatably supported by the carriage and connected to the supporting element, which is movable between an operating position, in which it arranges the supporting element in the lowered position, and a non-operating position, in which the lever arranges the supporting element in the raised position. A connecting element connects the lever and the supporting element.

Advantageously, the self-propelled wrapping machine according to the invention can be easily and handy moved and displaced by an operator in a maneuvering configuration, outside operating wrapping cycles. By virtue of the lifting device, it is in fact possible to easily detach the drive wheel from the supporting plane so that the drive wheel does not interfere, by slowing down the manual movement of the machine. In particular, by virtue of the lever that is connected with and acts on the supporting element, the operator has to exert a minimum effort to rotate the lever from the non-operating position to the operating position, i.e. to lift the drive wheel from the supporting surface.

Furthermore, by virtue of the lifting device it is not necessary to include a system in the machine of the invention for mechanically uncoupling the drive wheel from motor means which can be activated during the maneuvering configuration; thus the machine is very manoeuvrable and easily movable and also less complex and cheaper than the known self-propelled wrapping machines.

The invention can be better understood and implemented with reference to the attached drawings which illustrate an exemplary and non-limiting embodiment thereof, in which.

Figure 1:
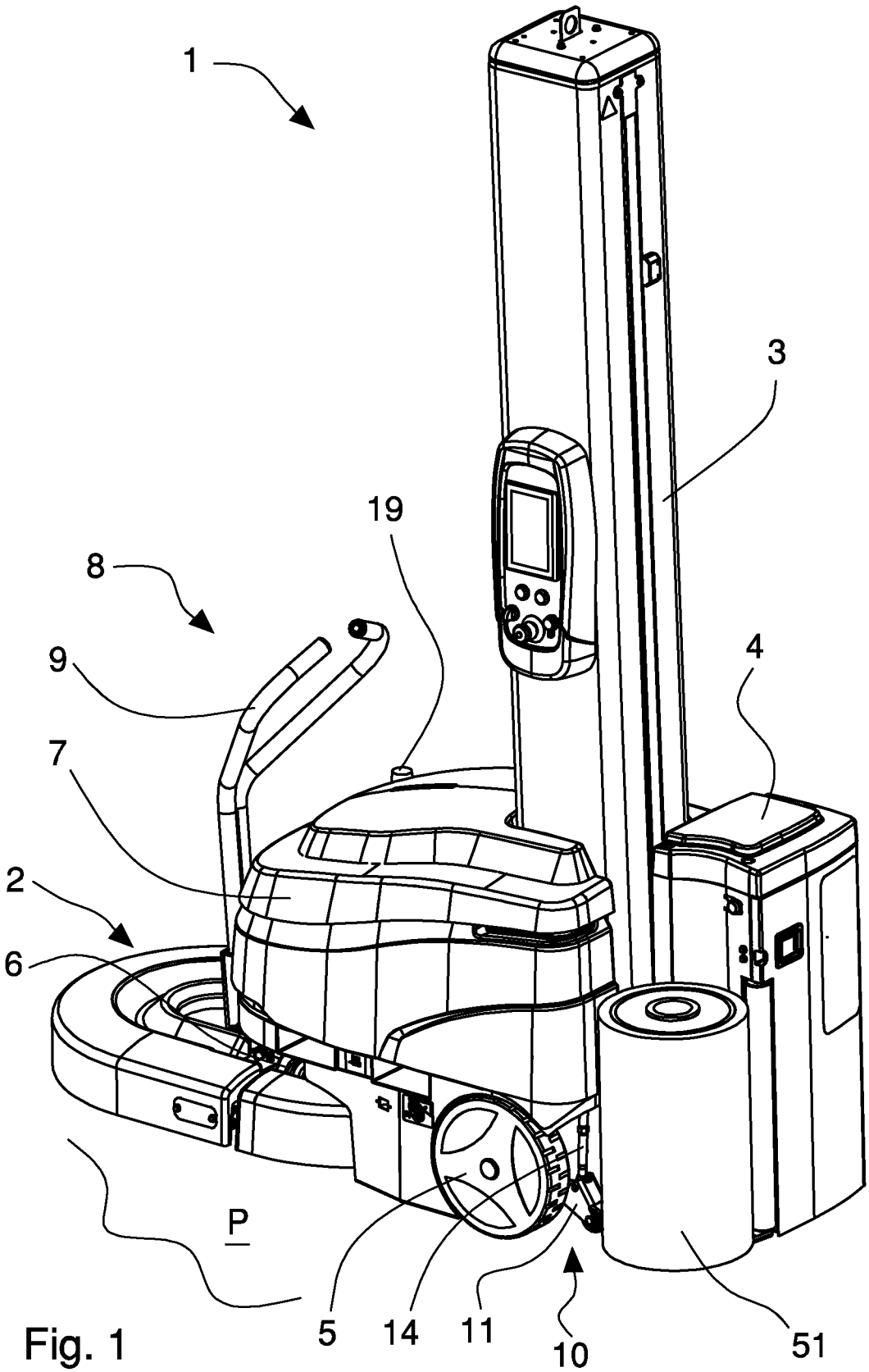
FIG. 1 is a perspective view of the wrapping machine of the invention.
Figure 3:
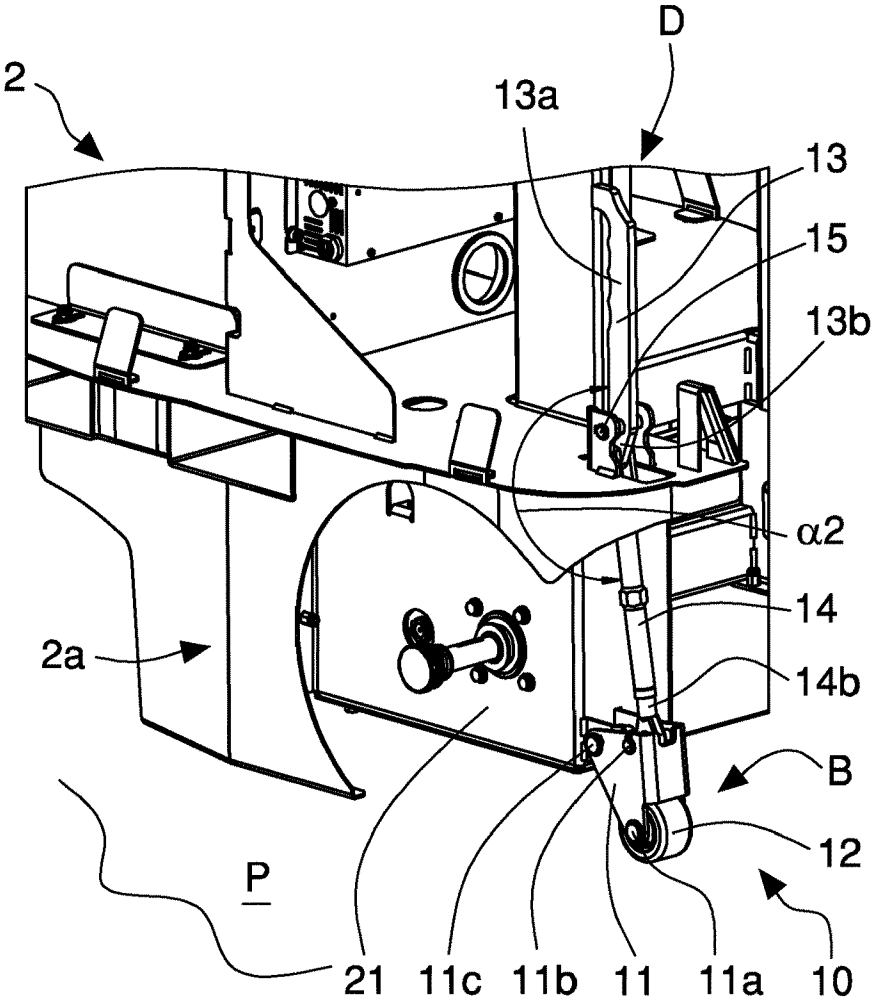
FIG. 3 is a view similar to that of FIG. 2 which illustrates the supporting element in lowered position.
Figure 2:
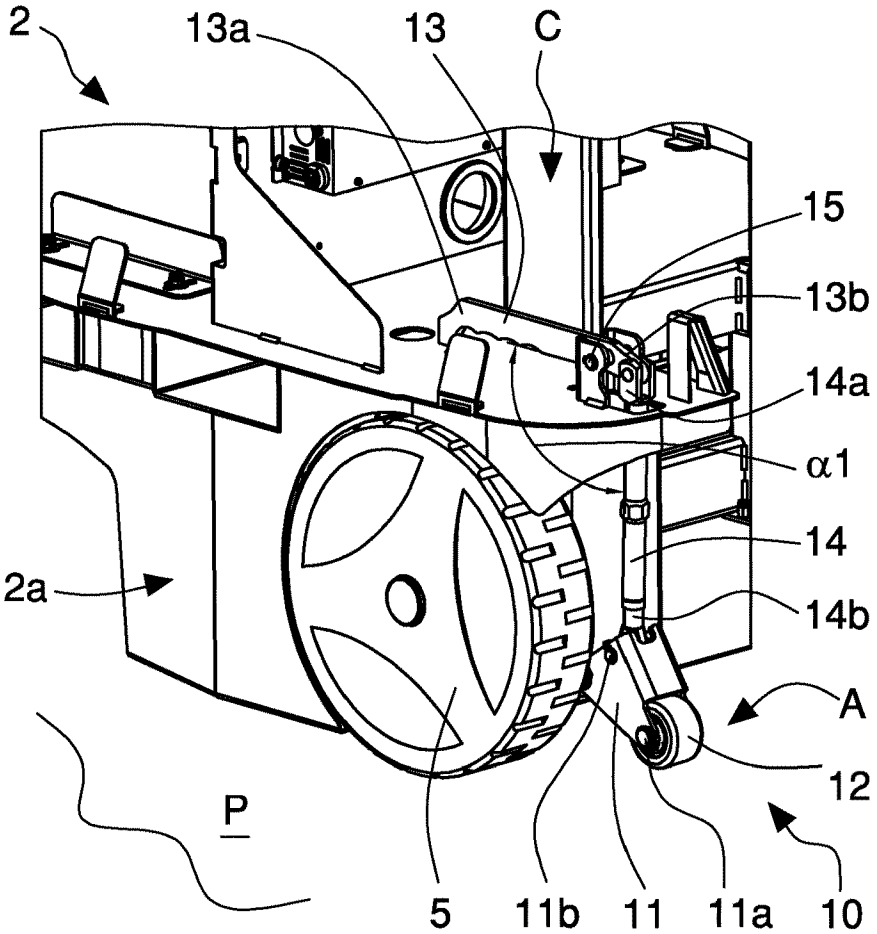
FIG. 2 is an enlarged partial view of the wrapping machine of FIG. 1 with a covering casing in open position in order to illustrate a lifting device of a drive wheel with a supporting element in the raised position.

With reference to FIGS. 1 to 3, a self-propelled wrapping machine 1 according to the invention (hereinafter called machine 1) is illustrated that is movable on a supporting plane P around a load to wrap it with a plastic film during a wrapping cycle. The supporting plane P is, for example, identified in the ground or in the floor of the place or environment in which the machine 1 is positioned. The load consists, for example, of one or more products arranged on a pallet or bed.

The machine 1 comprises a self-propelled or mobile carriage 2 and an upright 3 fixed to the carriage and slidably supporting an unwinding unit 4. A covering casing 7 encloses and forms an inner compartment of the carriage intended to receive, for example, an electric power supply battery. The covering casing 7 is movable in open position to allow accessing the inner compartment.

The unwinding unit 4, of the known type, is provided with a reel of film 51, for example of plastic material, and roller means for unwinding and/or pre-stretching the film, of known type and not shown in the figures.

The carriage 2 comprises at least one drive wheel 5 connected with and rotated by motor means of known type and not illustrated in the figures and at least one steering wheel 6 controlled by steering means 8 which can be manually operated by a maneuvering bar 9 or by a feeler element 19 suitable for following the outer walls of the load to be wrapped. The maneuvering bar 9 and the feeler element 19 are of known type and thus not described or illustrated in detail.

In the embodiment shown by way of example, the machine 1 comprises a pair of rear wheels of which only one is the drive wheel and a pair of front steering wheels 6 which can be oriented by the operator by means of the maneuvering bar 9 during manual maneuvering or by the feeler element during operation, rotating about the load.

The rear drive wheel 5 is positioned on the carriage 2 on the opposite side with respect to the feeler element, of known type and not illustrated, configured to follow the outer profile or shape of the load and orient the steering wheels accordingly, to which it is connected, in an operating work configuration, in which the self-propelled machine rotates autonomously and automatically around the load to wrap it with the film.

The machine 1 further comprises at least one lifting device 10 which includes a supporting element 11 provided with an auxiliary wheel 12 that is idle, i.e. free to rotate about its own rotation axis, and selectively movable between a raised position A, in which the auxiliary wheel 12 is spaced from the supporting plane P (FIG. 2) and a lowered position B, in which the auxiliary wheel 12 abuts the supporting plane P, lifting and detaching the drive wheel 5 from the supporting plane P (FIG. 3). More precisely, in the raised position A, the auxiliary wheel 12 is spaced from the supporting plane P so as not to interfere with the movement of the machine 1, leaving the drive wheel 5 in contact with the supporting plane P. In the lowered position B, the auxiliary wheel 12 abuts the supporting plane P and by pushing against the supporting plane P lifts the drive wheel 5 so that the drive wheel is detached from the supporting plane P.

The lifting device 10 is positioned on the carriage 2 at the drive wheel 5 and is accessible for its operation by lifting the covering casing 7 in open position.

The supporting element 11 is associated with a side 2*a* of the carriage 2 and is adjacent and near the drive wheel 5.

The supporting element 11 is in particular rotatably connected to the carriage 2 so that it can rotate with respect the carriage between the raised position A and the lowered position B. The lifting device 10 also comprises a lever 13 rotatably supported by the carriage 2 and connected to the supporting element 11. The lever 13 is selectively movable between a non-operating position C, in which the lever 13 arranges the supporting element 12 in the raised position A and an operating position D, in which the lever arranges the supporting element 12 in the lowered position B.

The lever 13 has an elongated shape and has a gripping first portion 13*a* adapted to be gripped by an operator and an operating second portion 13*b* connected to the supporting element 11. The lever 13 is rotatably connected to and supported by the carriage 2 at a fulcrum point 15 that is interposed between the first portion 13*a* and the second portion 13*b*. More precisely, the fulcrum point 15 divides and defines the first portion 13*a* and the second portion 13*b*.

In particular, the first portion 13*a* is shaped so as to be ergonomically gripped by an operator. According to an embodiment, the first portion 13*a* may be suitably shaped to facilitate gripping by the operator.

The gripping first portion 13*a* has a length longer that a length of the operating second portion 13*b* with reference to the fulcrum point 15, so as to advantageously carry out a lever 13 in which the operator's effort is minimal for changing the position of the supporting element 11, as better explained in the following description.

Furthermore, the lifting device 10 comprises a connecting element 14, suitable for connecting the lever 13 to the supporting element 11. More precisely, the connecting element 14 comprises a first end 14*a* rotatably connected to an end of the operating second portion 13*b* of the lever 13 and an opposite second end 14*b* rotatably connected to the supporting element 11. According to a preferred embodiment of the invention, the connecting element 14 has an elongated shape and is adjustable in length so as to adjustably connect the lever 13 and the supporting element 11. The connecting element 14 is for example a bar, tie rod or strut of cylindrical shape.

The supporting element 11 comprises, for example, a box-like element having an approximately triangular shape provided with a first vertex 11*a*, a second vertex 11*b* and a third vertex 11*c*. At the first vertex 11*a*, the auxiliary wheel 12 is rotatably connected, that is rotatable about a rotation axis almost parallel to the rotation axis of the drive wheel 5. The second end 14*b* of the connecting element 14 is rotatably connected to the second vertex 11*b*. Finally, the third vertex 11*c* of the supporting element 11 is rotatably connected by a supporting pin to an outer side wall 21 of the carriage 2, near the drive wheel 5.

In a mounting configuration of the supporting element 11 on the carriage 2 (FIG. 3), the first vertex 11*a* is closer to the supporting plane P and the second vertex 11*b* is farther from the supporting plane P.

In a preferred embodiment, the lever 13 in the non-operating position C forms with the connecting element 14 a first angle α1 that is comprised between 80° and 100°, while in the operating position D the lever 13 forms with the connecting element 14 a second angle α2 greater than 180° so as to prevent the spontaneous return of the lever 13 from the operating position D to the non-operating position C. An external force must therefore be applied by an operator to move the lever from the non-operating position C to the operating position D and vice versa.

Locking means, not shown in the figures, are provided for reversibly locking the lever 13 at least in the operating position D so as to prevent the spontaneous movement of the lever from the operating position D to the non-operating position C.

The locking means can be carried out by means of a shaped rotating element positioned near the fulcrum point 15, for example a cam, acting on the end of the second portion 13*b* of the lever 13.

In the operation of the machine 1 during a load wrapping cycle the lever 13 is positioned in the non-operating position C and the supporting element 11 is arranged in the raised position A, so that the auxiliary wheel 12 is spaced from the supporting plane P and does not interfere with the movement of the machine 1 leaving the drive wheel 5 in contact with the supporting plane P to move the machine 1 around the load.

At the end of the wrapping cycle, if the operator needs to move the machine 1, for example from a first load to a second load, he actuates the first lever 13, in particular, he grips the first portion 13*a* of the lever 13 by lifting the lever and rotating it with respect to the fulcrum point 15 in order to move the lever from the non-operating position C to the operating position D. The lever 13, by rotating in the operating position D, moves the supporting element 11 from the raised position A to the lowered position B by means of the connecting element 14. During the move from the raised position A to the lowered position B, the auxiliary wheel 12 abuts the supporting plane P and progressively lifts a portion of the carriage 2 at the drive wheel 5 until it detaches the drive wheel from the supporting plane P. In other words, when the supporting element 11 is in the raised position A, the drive wheel 5 is spaced from the supporting plane P and does not interfere with the movement of the machine 1, allowing the operator to easily move and displace the machine, in particular to manually drive the machine into a maneuvering configuration by means of the maneuvering bar 8.

It should be noted that since the gripping first portion 13*a* has a length much longer than the length of second portion 13*b* with reference to the fulcrum point 15, a lever 13 is carried out in which the operator's effort is minimal for changing the position of the supporting element 11. More precisely, the lever 13 is an advantageous first class lever in which the effort arm (the first portion 13*a*) that is grasped by the operator has a length longer than the length of the resistance arm (the second portion 13*b*) connected to the supporting element 11. The force which the operator must exert to lift the lever 13 is thus much lower than the force necessary to lift the drive wheel 5.

When the operator has moved the machine 1, he can act on the lever 13 again to return it from the operating position D to the non-operating position C. At the same time as changing the position of the lever 13, the supporting element 11 is moved from the lowered position B to the raised position A and the auxiliary wheel 12 is lifted from the supporting plane P, allowing the drive wheel 5 to return to abut and rest on the supporting plane P.

The self-propelled wrapping machine according to the invention can therefore be easily and handy moved and displaced by an operator in a maneuvering configuration, outside operating wrapping cycles.

Thanks to the lifting device 10, it is in fact possible to easily separate the drive wheel 5 from the supporting plane so that drive wheel does not interfere, slowing down the manual movement of the machine 1. In particular, thanks to the shape of the lever 13 (advantageous first class lever) that is connected with and acts on the supporting element 11 through the connecting element 14, the operator has to exert a minimum effort in order to rotate the lever from the non-operating position C to the operating position D, i.e. in order to lift the drive wheel 5 from the supporting plane P.

It should also be noted that, thanks to the lifting device 10 it is not necessary to include a system in the machine 1 of the invention for mechanically uncoupling the drive wheel from the motor means, which has to be activated during the maneuvering configuration; thus the machine is very manoeuvrable and easily movable and less complex and cheaper than the known self-propelled wrapping machines.

According to an alternative embodiment of the self-propelled wrapping machine 1 of the invention, the carriage 2 may comprise a pair of rear drive wheels 5 and a pair of relative lifting devices 10. In particular, each lifting device 10 is positioned on the body 2 so as to lift the relative drive wheel 5 in a maneuvering configuration.

According to another embodiment of the invention, the supporting element 11, alternatively to being rotatable, is slidably connected to the carriage 2 so as to be movable linearly between the lowered position B and the raised position A. In this variant, the lifting device 10 comprises driving means, for moving the supporting element 11 between the raised position A and the lowered position B.

For example, the driving means are screw-mother screw means, which transform a rotary motion exerted by the operator into a linear motion of the supporting element 1. The operation of such a preferred embodiment is entirely similar to what has been described above.

According to an alternative embodiment of the invention the connecting element 14 is movable according to a combined motion of roto-translational type.

The invention claimed is:

1. A self-propelled wrapping machine movable on a supporting surface to wrap a load with a plastic film, comprising:

a self-propelled carriage provided with at least one drive wheel suitable for moving said self-propelled wrapping machine;

at least one steering wheel controlled by a steering system that can be manually operated by a maneuvering bar or by a feeler element suitable to follow external walls of the load to be wrapped;

an upright fixed to said carriage and slidably supporting an unwinding unit provided with at least a reel of film;

at least one lifting device which includes a supporting element provided with an idle auxiliary wheel, said supporting element being associated with said carriage and selectively movable between a raised position, in which said auxiliary wheel is spaced from said supporting plane, and a lowered position, in which said auxiliary wheel abuts said supporting plane and lifts and detaches said drive wheel from said supporting plane;

wherein said supporting element is rotatably associated with a side of said carriage, adjacent to said drive wheel so as to rotate between said raised position and said lowered position and in that said lifting device comprises:

a lever rotatably supported by said carriage, connected to said supporting element and movable between a non-operating position, in which said lever arranges said supporting element in the raised position, and an operating position, in which said lever arranges said supporting element in the lowered position; and a connecting element suitable for connecting said lever and said supporting element.

2. The self-propelled wrapping machine according to claim 1, wherein said lever has an elongated shape and has a gripping first portion adapted to be gripped by an operator and an operating second portion that is connected to said supporting element, said lever being rotatably connected to, and supported by, said carriage at a fulcrum point that is interposed between said first portion and said second portion.

3. The self-propelled wrapping machine according to claim 2, wherein said gripping first portion has a length longer than the length of said operating second portion.

4. The self-propelled wrapping machine according to claim 2, wherein said connecting element comprises a first end rotatably connected to an end of said operating second portion of said lever and an opposite second end rotatably connected to said supporting element.

5. The self-propelled wrapping machine according to claim 1, wherein said connecting element has an elongated shape and is adjustable in length.

6. The self-propelled wrapping machine according to claim 1, wherein said lever forms a first angle with said connecting element in said non-operating position that is comprised between 80° and 100° and in said operating position forms a second angle wider than 180°.

7. The self-propelled wrapping machine according to claim 1, wherein said carriage comprises two drive wheels and two lifting devices, each lifting device being associated with a respective drive wheel in order to lift and detach said drive wheel from the supporting plane.

* * * * *